US007286774B1

(12) United States Patent
Miller et al.

(10) Patent No.: US 7,286,774 B1
(45) Date of Patent: Oct. 23, 2007

(54) UNIVERSAL PRINTER CHIP

(75) Inventors: Steven Miller, Pinellas Park, FL (US); Herman Schnell, Coral Springs, FL (US)

(73) Assignee: Cartridge Corporation of America, Inc., Clearwater, FL (US)

( * ) Notice: Subject to any disclaimer, the term of this patent is extended or adjusted under 35 U.S.C. 154(b) by 85 days.

(21) Appl. No.: 11/162,878

(22) Filed: Sep. 27, 2005

Related U.S. Application Data

(63) Continuation-in-part of application No. 10/742,323, filed on Dec. 19, 2003, now Pat. No. 7,136,608.

(51) Int. Cl.
*G03G 15/00* (2006.01)

(52) U.S. Cl. ..... 399/12; 399/109

(58) Field of Classification Search ..... 399/12, 399/13, 24, 25, 107, 109, 110, 111; 347/19, 347/20, 49, 84, 152
See application file for complete search history.

(56) References Cited

U.S. PATENT DOCUMENTS

| | | | | |
|---|---|---|---|---|
| 6,104,888 | A | 8/2000 | Kobayashi | |
| 6,263,170 | B1 | 7/2001 | Bortnem | |
| 6,385,407 | B1 * | 5/2002 | Inose | 399/24 |
| 6,406,128 | B2 * | 6/2002 | Lee et al. | 347/19 X |
| 6,529,691 | B2 | 3/2003 | Guy et al. | |
| 6,539,867 | B2 * | 4/2003 | Lee | 347/19 X |
| 6,636,702 | B2 * | 10/2003 | Abe | 399/12 |
| 6,701,096 | B2 | 3/2004 | Arai et al. | |
| 6,882,810 | B2 * | 4/2005 | Karagiannis et al. | 399/109 |
| 6,904,400 | B1 | 6/2005 | Peri et al. | |
| 6,931,216 | B2 | 8/2005 | Mochizuki et al. | |
| 6,941,082 | B2 | 9/2005 | Urabe | |
| 2003/0035017 | A1 | 2/2003 | Helterline et al. | |
| 2003/0063311 | A1 | 4/2003 | Covitt et al. | |
| 2005/0036800 | A1 | 2/2005 | Karagiannis et al. | |

OTHER PUBLICATIONS

Lexmark & IBM Introduce New Firmware to Thwart Aftermarket Cartridge Chips, Imaging Spectrum Magazine, Sep. 2002, p. 75.

* cited by examiner

*Primary Examiner*—Sandra L. Brase
(74) *Attorney, Agent, or Firm*—Thomas E. Toner; Smith & Hopen, P.A.

(57) ABSTRACT

A toner cartridge having a microcontroller configured to store data necessary to create a message authentication code required by the printer. The microcontroller contains data values capable of generating acceptable MACs for a plurality of printers. The microcontroller recognizes a variety of unique parameters displayed by the printer's processor to identify the printer being used. Once the printer is identified, the microcontroller loads the data values associated with the printer and generates an acceptable MAC to enable printer operation.

27 Claims, 6 Drawing Sheets

UNIVERSAL PRINTER CHIP

CROSS REFERENCE TO RELATED APPLICATIONS

This application claims priority to co-pending U.S. patent application Ser. No. 10/742,323 entitled: "Removable Toner Cartridge Universal Adapter," filed Dec. 19, 2003 and International Patent Application PCT/US05/11160 entitled: "Integrated Toner Cartridge with Toner Agitator and Sensing Device," filed Apr. 1, 2005, which are fully incorporated herein by reference.

BACKGROUND OF THE INVENTION

The present invention relates to a toner cartridge adapted to fit within a toner cartridge-receiving cavity of a printer.

Laser printers use a coherent beam of light, hence the term "laser printer," to expose discrete portions of an image transfer drum thus attracting the printing toner. Toner is a mixture of pigment (most commonly black) and plastic particles. The toner becomes electro-statically attracted to exposed portions of the photoconductive transfer drum.

The photoconductive drum rotates opposite the developer roller, the developer roller being in fluid contact with the toner. The toner is transferred to paper, or other medium, as it passes over the rotating image transfer drum. Subsequently, the paper is heated so that the plastic is melted thereby permanently affixing the ink to the paper.

Most printer manufacturers design their printers to accept toner cartridges manufactured by it and to reject the toner cartridges manufactured by others. More particularly, to increase sales of their own toner cartridges, printer manufacturers have added electronic identification features to the printers and to the toner cartridges that do not enhance the functional performance of the printer in any way but which serve to prevent use of a competitor's toner cartridge in the printer. Printer manufacturers also prefer to sell new toner cartridges to replace empty toner cartridges. Therefore, they do not support the re-cycling industry.

Thus there is a need for a universal printer chip that enables a single toner cartridge to be used with printers made by differing manufacturers and with differing printer's models made by a common manufacturer. In addition to new cartridges, such a universal printer chip could be used in conjunction with spent cartridges that are re-filled with toner when empty by the re-cycling industry.

SUMMARY OF INVENTION

The long-standing but heretofore unfulfilled need for a toner cartridge that enables a single toner cartridge to be used with printers made by differing manufacturers and with differing printers models made by a common manufacturer, and which also includes other improvements that overcome the limitations of prior art toner cartridges is now met by a new, useful, and non-obvious invention.

In one embodiment, the present invention provides a method of communicating a message authentication code for a toner cartridge to a printer, such as a printer, having a processor containing a lock-out algorithm. A toner cartridge equipped with a microcontroller engages in bidirectional communication with the processor of the printer when the cartridge is installed in the toner cartridge-receiving cavity of the printer. A look-up table containing a cross-reference of processor-command algorithms, identified by a distinct communication pattern, corresponding to various printer models is stored on the microcontroller.

The printer firmware on the processor communicates a command, or series of commands, to the microcontroller to verify the toner cartridge is an authorized component. The sequence of commands from the processor forms a communication pattern recognized by the microcontroller. The communication pattern originated by the processor matches a corresponding communication pattern on the look-up table which provides the identity of the printer in question.

The firmware on the microcontroller recognizes the identity of the printer and generates a suitable Message Authentication Code (MAC). The MAC is transmitted to the processor, thereby establishing the electronic "handshake" necessary to enable operation of the printer.

In one embodiment, the microcontroller is capable of storing at least one data value associated with a toner cartridge status parameter on the microcontroller. A status parameter can be any value or characteristic of the cartridge, including those unique to the microcontroller, requested by the printer. In alternate embodiments, the MAC is generated using different data values stored on the microcontroller. Although multiple algorithms can be used to generate the MAC, one embodiment employs a Secure Hash Algorithm (SHA-1).

Examples of data values used to calculate the MAC include, but are not limited to a serial number associated with the microcontroller, a secret code, or a ROM ID. Moreover, a data value can be used to communicate parameters such as toner volume, page yield, or the like. In another embodiment, the MAC is generated using at least one data value stored on the microcontroller and a challenge code initiated by the processor. Although the mode of communication between the microcontroller and the processor can vary, one embodiment uses communication established through a single wire bus architecture protocol.

It may occur that two or more printers share similar communication patterns. If the microcontroller communicates the wrong MAC, the processor will generate an error code. In this embodiment, the microcontroller is capable of generating a second, or more, MACs responsive to the error code. Subsequent MACs are transmitted to the processor by re-initializing the apparatus startup routine; by opening and closing the lid on a printer for example.

Alternate embodiments utilize other information sent by the processor to identify the printer. For example, one embodiment employs a microcontroller capable of detecting the different communication timings of the data signals. Different printers use different processors which in turn operate at different speeds. A look-up table is established to identify the printer as described above.

In yet another embodiment, a microcontroller capable of detecting the different voltage levels. As with the previous embodiment, different use different processors which produce different voltage values over time. A look-up table is established to identify the printer as with the previous embodiments.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
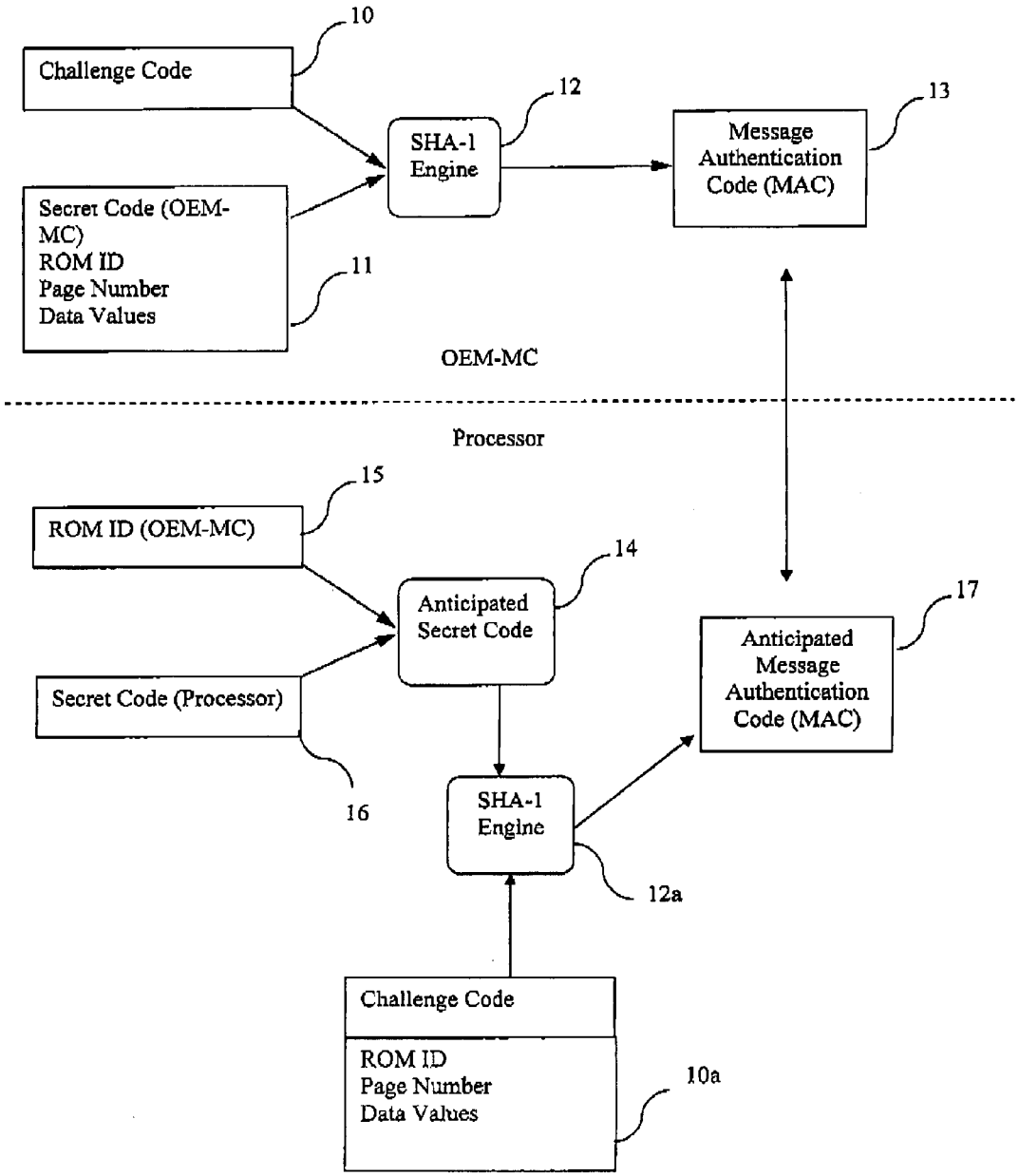
FIG. 1 is block diagram representing the challenge-and-response protocol employed by many OEM manufactures.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Terms

As used herein, the term "processor" refers to any portion of a printer that interprets, carries out, or processes, instructions or data contained in the software or firmare contained therein.

As used herein, the term "printer" refers to any image forming apparatus that accepts the use of a toner cartridge. Examples include, but are not limited to, printers or copying machines or other electro-photographic devices.

As used herein, the term "microcontroller" is any system, device, or execution unit with added functionality capable of implementing the method as described. Accordingly, the "microcontroller" must be capable of storing information, receiving signals originated from an outside source, and transmitting signals to an outside source. Although it is preferred, it is not necessary that the "microcontroller" be implemented on a single monolithic integrated circuit.

As used herein, the term "communication pattern" is any communication, command, request, or data value originated by a processor. A "communication pattern" can be established by any number of communications, commands, requests, or data values including the lack thereof.

OEM Toner Cartridge Authentication

Some printers, such as the LEXMARK® T420, T420, T520, T522, T620, T622, T630, T632, T 634, T640, T642, T644, E320, E321 Laser printers and their derivatives for example, contain firmware designed to enforce so-called "Pre-Bate" licenses. Toner cartridges equipped with Original Equipment Manufacturer printer chips (OEM-PCs), like the DS2432 manufactured by DALLAS SEMICONDUCTOR®, are coupled with one-wire bus technology to lock-out non-OEM toner cartridges. These OEM-PCs use a 512-bit-SHA-1 (Secure Hash Algorithm) engine to generate a 160-bit Message Authentication Code (MAC) for each page of data stored on the OEM-PC.

Data stored on any data page can include information value that may be requested by a processor on the printer during operation. Examples include the serial number of the cartridge, the yield, toner levels, model type, etc. When the processor requests information from a data page on the OEM-PC, the SHA-1 engines generates a MAC using stored data values such as the OEM-PC's unique ROM ID, the data on the requested page, and/or a "secret" code stored on the OEM-PC. Systems with higher security also incorporate a "challenge code" issued by the processor prior to requesting the page at issue. Hence, an OEM toner cartridge can be limited to use in a single printer by providing a data value on the OEM-PC that it is only capable of generating an acceptable MAC for that printer model.

FIG. 1 shows how the authentication MAC is constructed. Upon activation of the OEM-PC, the processor issues a challenge code 10 to the OEM-PC. Challenge code 10 is combined with data values associated with a toner cartridge status parameter stored on the OEM-PC 11. Challenge code 10 and data values 111 are processed by the in-circuit SHA-1 engine 12 to generate MAC 13.

The processor computes an anticipated MAC 17 using an anticipated OEM-PC secret 14. Anticipated OEM-PC secret 14 is created by combining a master secret 16 contained within the processor and the ROM ID of the OEM-PC 15. The processor uses the same information used by the OEM-PC 10*a* to calculate anticipated MAC 17 through a SHA-1 engine 12*a* on the processor. If the MAC generated by the OEM-PC does not match the anticipated MAC, an error code is generated.

Universal Printer Chip Authentication

The inventive method incorporates a microcontroller that emulates an OEM-PC and is able to transmit the necessary data to communicate with the printer being used. By way of example, a microcontroller of the Texas Instruments MSP430 family could be implemented although other microcontrollers could also be used. Microcontrollers of the MSP430 family are useful, as this family of microcontrollers possess analog-to-digital conversion capabilities that are highly configurable and can run largely free of program involvement.

A microcontroller, such as the MSP430 can be modified to emulate an OEM-PC and communicate with a printer, not-withstanding the one-wire lock-out protocol. OEM-PC commands are emulated by installing a firmware program that makes the microcontroller operate in the same fashion as the OEM-PC. The firmware emulation step is completed by storing the correct data values in the microcontroller.

The firmware emulation step being complete, the next step is to make the toner cartridge equipped with the microcontroller functional in multiple printers without needing to load new values for each printer model and brand or replacing the printer chip in the cartridge. Accordingly, the inventors provide a method of detecting which printer is being utilized by allowing the microcontroller to recognize a parameter unique to the printer being used. Identification can be achieved by having the microcontroller recognize different communication patterns, different communication timing on the data signals, and/or different voltage levels at the data connections.

Communication-Pattern Identification

All printers are equipped with software that controls the printer engine and printer controller. This firmware on the processor controls the operation of the printer and determines what commands/requests are sent to the microcontroller and in what order. Accordingly, different model printers are controlled by different firmware, presumably written by different authors, and different hardware. It is therefore possible to establish a look-up table cross-referencing a plurality of known communication patterns with various printer models.

EXAMPLE 1

The processor for Printer Model A recognizes a start-up event (such as closing the printer-door); it searches for the microcontroller on the toner cartridge. Once detected, Printer Model A sends a request to the microcontroller for the data in memory location 20h, then a request for the data in memory location 30h, and finally a request for the data in memory location 00h. In contrast, when the firmware for Printer Model B recognizes a start-up event it sends a read-request to memory location 00h, followed by 20h, and finally location 30h. Printer Model C initiates contact with a read request for memory location 30h.

Figure 2:
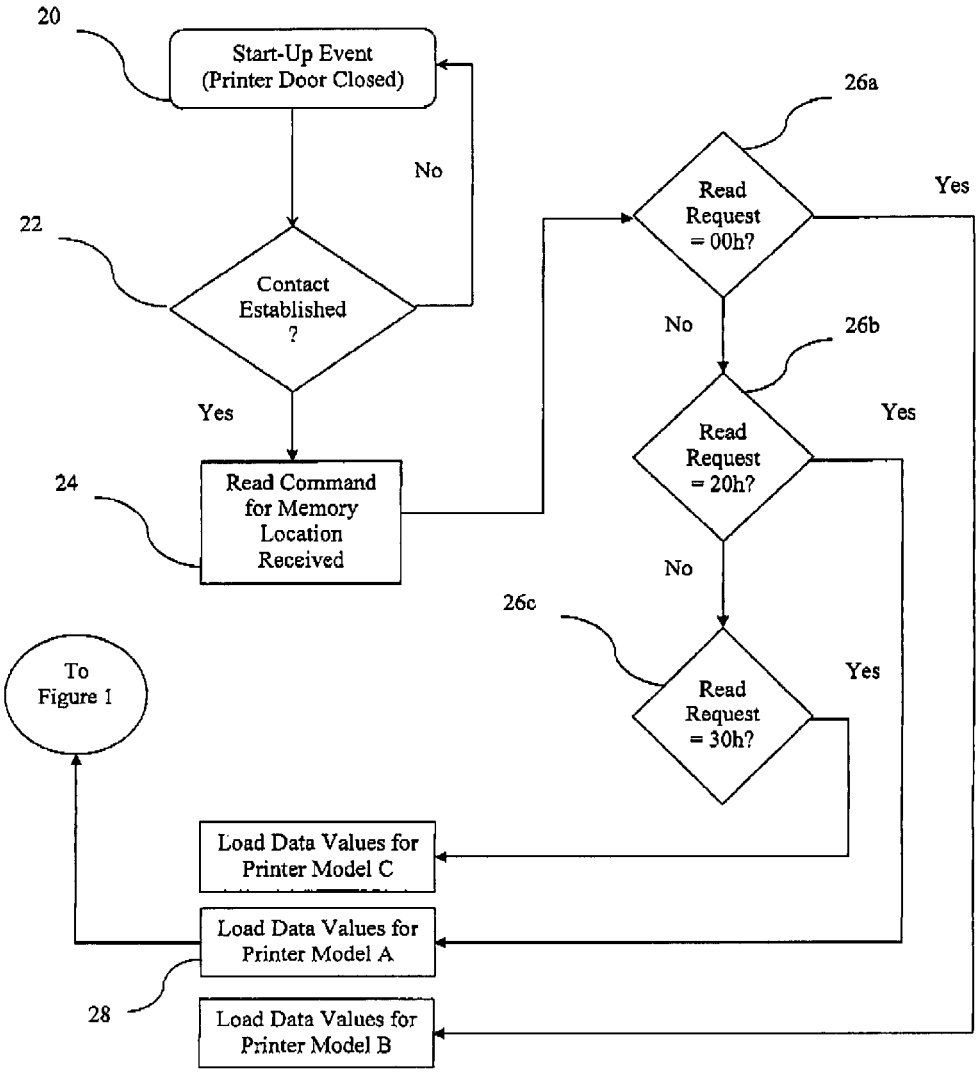
FIG. 2 is a simplified block diagram of a general embodiment of the present invention wherein the microcontroller monitors the communication pattern of the processor to identify the printer.

FIG. 2 illustrates the program flow of a preferred embodiment. After start-up event 20, the processor establishes bidirectional communication with the universal microcontroller 22. The microcontroller will then wait for a read command from the processor. Upon receiving the read command 24 for memory location 20h first, microcontroller will compare the request against the look-up table 26*a-c*. In this example Printer Model A is the only printer that initiates communication with a read command for memory location 20h (26*b*). The microcontroller recognizes the host printer as Printer Model A and loads the data values associated therewith 28. With the proper data values 28 loaded, the microcontroller can calculate a MAC that will match with the MAC calculated by the processor (FIG. 1).

EXAMPLE 2

It is possible for more than one printer model to use the same communication pattern to read memory locations on a microcontroller. The present invention provides a toggle-identification system to provide multiple data values for use in MAC generation, responsive to duplicate communication patterns.

Figure 3:
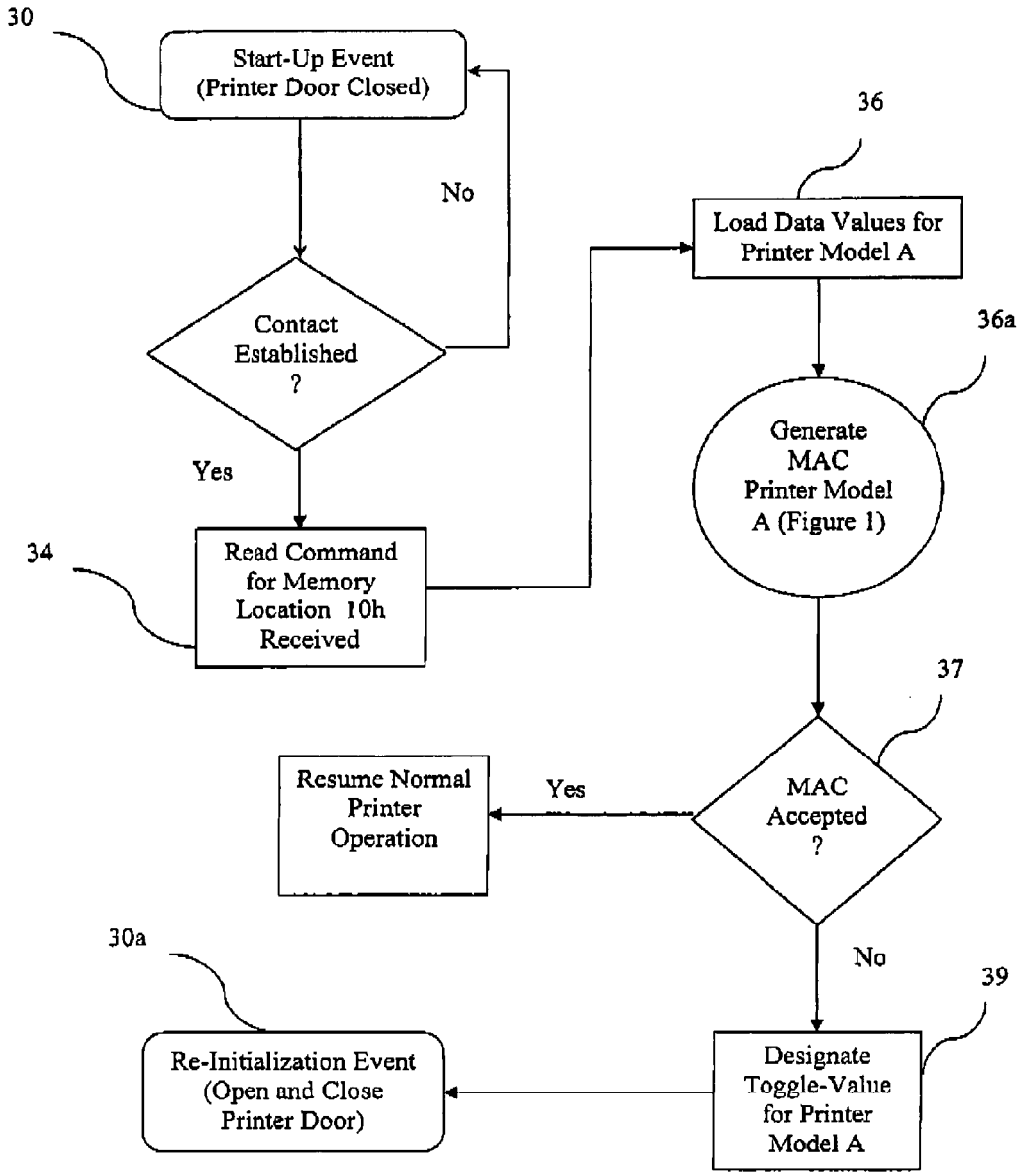
FIG. 3 is a simplified block diagram of a first toggle-identification subroutine of a preferred embodiment wherein multiple printer models have similar communication patterns.

FIG. 3 illustrates the first toggle-identification subroutine of a preferred embodiment. When the processor of both Printer Models A and B recognize a start-up event 30 they send an identical read-request 34: first to memory location 00h, followed by 20h, and finally location 30h. Assuming the cartridge was installed in Printer Model B, the microcontroller would not be able to positively recognize the printer as Model B. Upon receiving the read-request for memory location 00h the microcontroller accesses the look-up table and identifies the printer as Model A 36. When the microcontroller generates a MAC using the data values stored for Model A 36*a*, printer Model B generates a conflicting MAC and rejects the cartridge (i.e. "32 Unsupported Print Cartridge" message) 37. Having received an error code, the microcontroller stores a data value that initiates the toggle mechanism 39. Responsive to the error code, the user re-initializes start-up (presumably by opening and closing the printer door) 30*a*.

Figure 4:
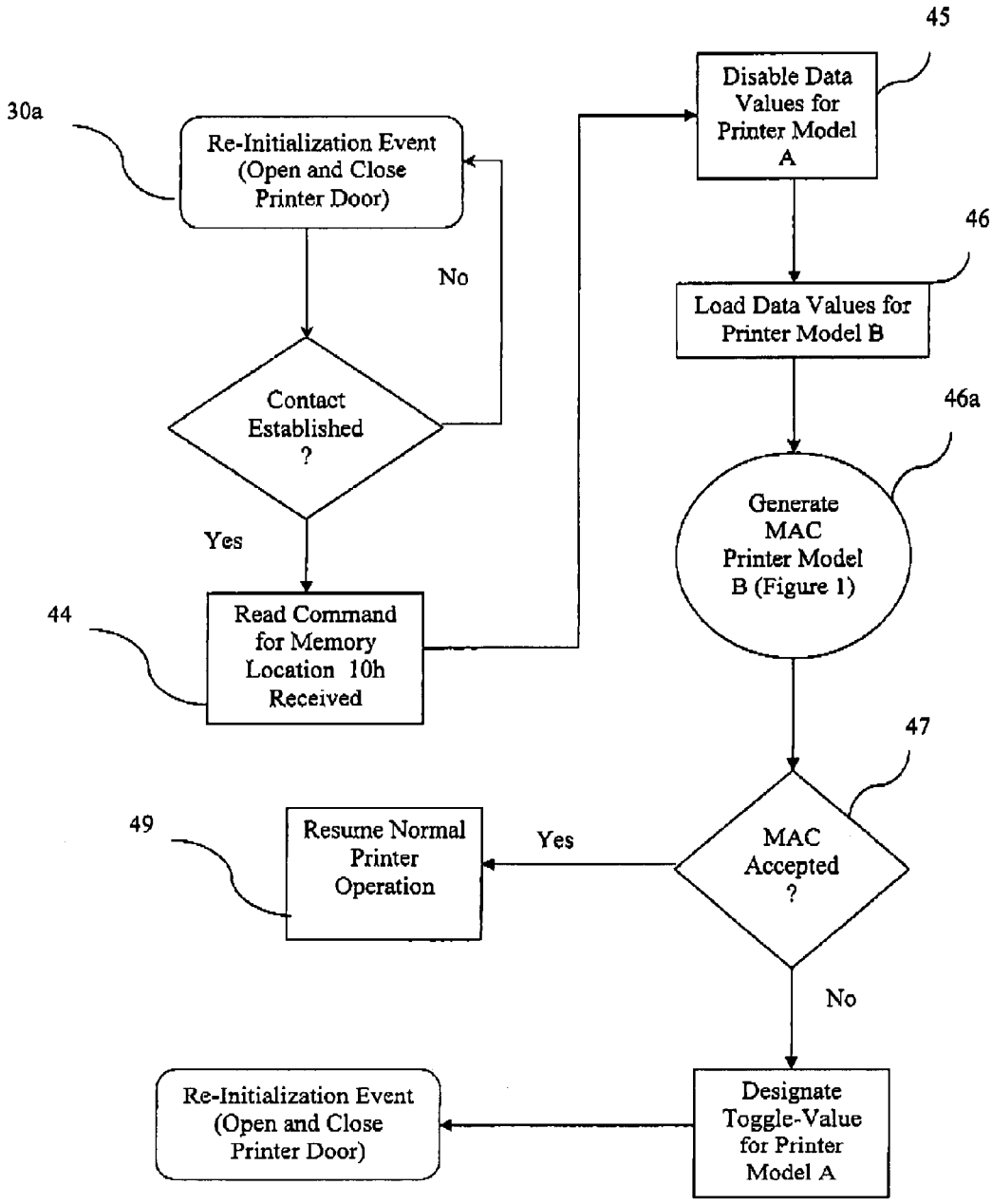
FIG. 4 is a continuation of FIG. 3 a represents simplified block diagram of a second toggle-identification subroutine where multiple printer models have similar communication patterns.

FIG. 4 illustrates the second toggle-identification subroutine activated after re-initialization event 30*a*. The processor for Printer Model B now requests data from memory location 00h 44 and the microcontroller again references the look-up table. The microcontroller then returns to Printer A but acknowledges the data value associated with the error code; thereby recognizing that Printer Model A is not the correct printer 45. The microcontroller then continues to reference the look-up table and recognizes the same communication pattern for Printer Model B 46. The microcontroller generates a MAC using the data values stored for Printer Model B 46*a*. Printer Model B generates an acceptable MAC, completing the authentication process 47. The authentication process completed, normal printer operations resume 49. While the foregoing examples relate to a scenario where two printers share a common identity parameter, this process is not limited by the number of printers that posses identical communication patterns.

The present invention envisions alternate embodiments with regard to the toggle-data value. In one embodiment the toggle-data value remains active thereby causing the microcontroller to continue transmitting data associated with Printer Model B until another error code is received. Alternatively, the toggle-data value can be permanent; thereby "locking" the cartridge to Printer Model B.

Communication-Timing Identification

As previously discussed, communication values vary between models since different printer models are equipped with different processors (having different clock speeds) and run different firmware. It is therefore possible to establish a look-up table cross-referencing a plurality of lapsed-time values (ΔT) with various printer models. In another embodiment of the invention, the microcontroller identifies the printer by measuring a lapsed-time value (ΔT) defined as the time it takes for the printer to initiate communication after a start-up event.

Figure 5:
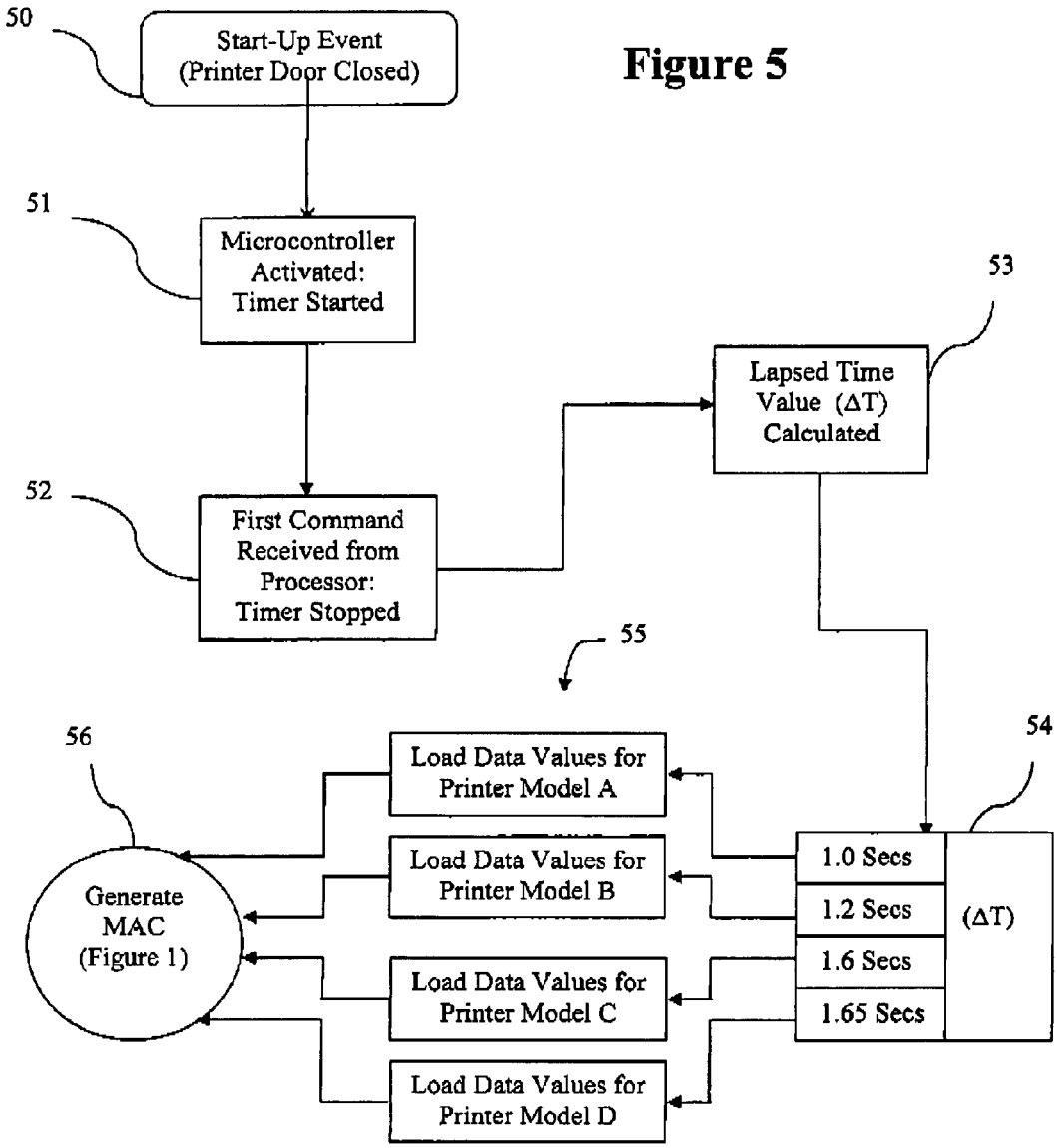
FIG. 5 is a simplified block diagram of a general embodiment of the present invention wherein the microcontroller monitors the time between initialization and the first communication received by the processor to identify the printer.

This embodiment is similar to the embodiment discussed above. As shown in FIG. 5, upon start-up event 50 the microcontroller is activated and a timer started 51. When the microcontroller receives the first command from the printer the timer is stopped 52 yielding a lapsed-time value (ΔT) 53. Lapsed-time value (ΔT) 53 is then compared to the values stored in look-up table 54 where it is matched to identify a printer model. With the proper printer model identified, the correct data values 55 can be loaded into the SHA-1 engine and a model-specific MAC generated (FIG. 1) 56.

As with the communication-pattern identification embodiment, discussed above, it is possible for more than one printer model to have the same lapsed-time value (ΔT). A toggle-identification system, substantially similar to that described above (see FIGS. 3 and 4), provides multiple data values for generating the MAC, responsive to duplicate lapsed-time values (ΔT).

Voltage-Value Identification

In still another embodiment, the microcontroller is capable of detecting different voltage levels received from the printer. As with the previous embodiment, different use different processors which produce different voltage values over time. A look-up table is established to identify the printer as with the previous embodiments. The microcontroller receives the voltage level through the data connections with the processor. In one embodiment, the microcontroller converts the voltage level to a voltage value. Such conversion is facilitated by an analog-to-digital (A/D) conversion function found on many microcontrollers. Although the use of an (A/D) conversion function is discussed, any method known in the art of converting the voltage received from the processor to a data value is envisioned. Examples of methods of determining a voltage value between a printer and a cartridge in communication therewith include: U.S. Pat. No. 6,701,096 to Arai et al, U.S. Pat. No. 6,529,691 to Guy et al, U.S. Pat. No. 6,263,170 to Bortnem, and U.S. Pat. No. 6,104,888 to Kobayashi, which are incorporated herein by reference.

Figure 6:
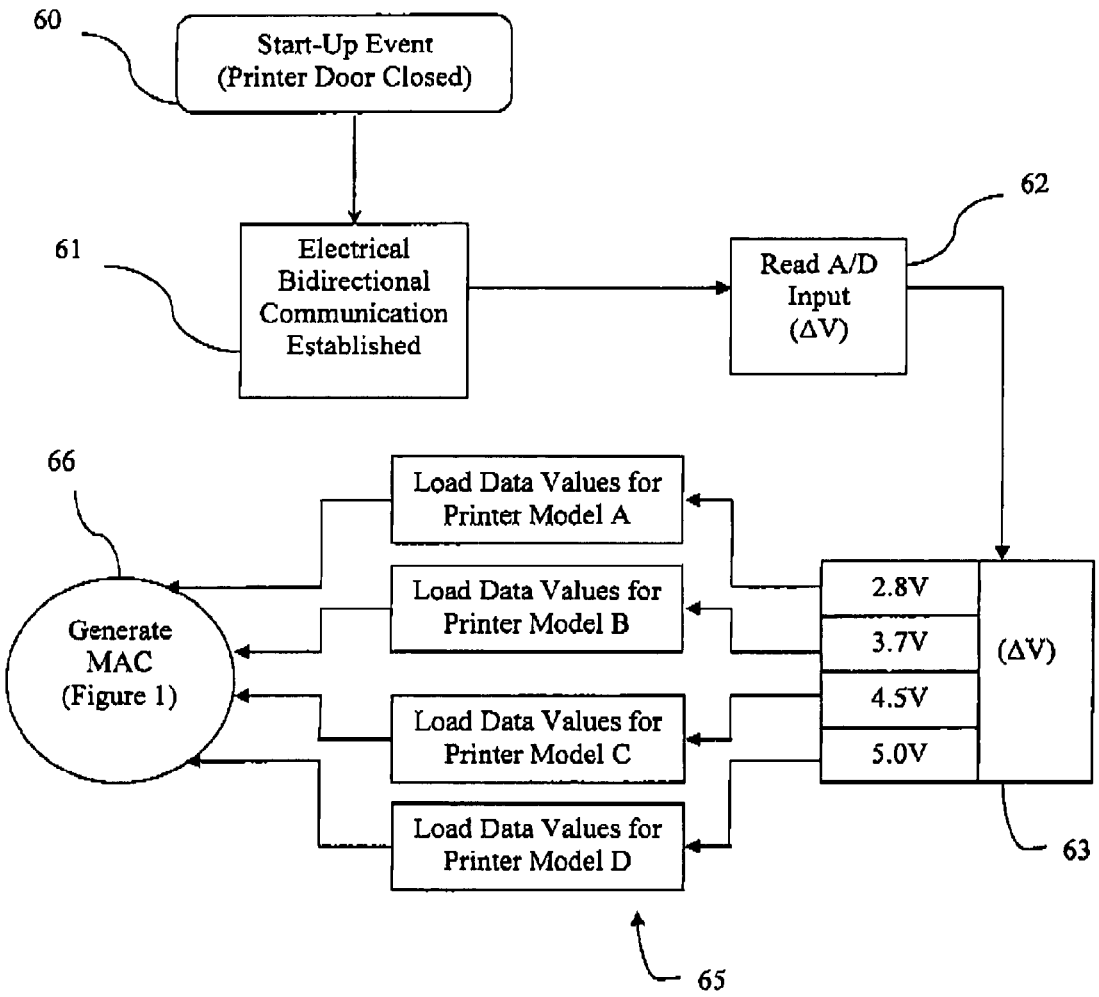
FIG. 6 is a simplified block diagram of a general embodiment of the present invention wherein the microcontroller monitors the voltage level generated by the processor to identify the printer.

FIG. 6 illustrates the program flow of the voltage recognition subroutine. Upon start-up event 60 the microcontroller makes electrical contact with the processor 61. The microcontroller receives voltage through the data connections with the processor. The microcontroller converts the voltage level to a voltage value (ΔV) 62. Voltage value (ΔV) is then compared to the values stored in look-up table 63 where it is matched to identify a printer model. With the proper printer model identified, the correct data values 65 is loaded into the SHA-1 engine and a model-specific MAC is generated (FIG. 1) 66.

As with the previous embodiments, discussed above, it is possible for more than one printer model to yield the same voltage value (ΔV). The toggle-identification system, substantially similar to that described above (see FIGS. 3 and 4), provides multiple data values for use in MAC generation, responsive to duplicate voltage values (ΔV).

It will be seen that the objects set forth above, and those made apparent from the foregoing description, are efficiently attained and since certain changes may be made in the above construction without departing from the scope of the invention, it is intended that all matters contained in the foregoing description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A method of communicating a message authentication code for a toner cartridge to a printer having a processor containing a lock-out algorithm, comprising the steps of:

providing a toner cartridge having a microcontroller in bidirectional communication with said processor when the cartridge is installed in the printer;

establishing a look-up table defining a plurality of processor-command algorithms associated with a plurality of printer models;

recognizing a communication pattern originated by the processor of the printer;

identifying at least one printer by matching the communication pattern from the processor of the printer to a processor-command algorithm defined on the look-up table;

generating a message authentication code associated with the identified printer; and transmitting the message authentication code to the processor.

2. The method of claim 1 further comprising the step of storing at least one data value associated with a toner cartridge status parameter on the microcontroller.

3. The method of claim 2 where at least one data value stored on the microcontroller is selected from the group consisting of a serial number associated with the microcontroller, a secret code, and a ROM ID.

4. The method of claim 2 where the message authentication code is generated using at least one data value stored on the microcontroller.

5. The method of claim 2 where the message authentication code is generated using at least one data value stored on the microcontroller and a challenge code initiated by the processor.

6. The method of claim 5 where the message authentication code is generated by a SHA-1 (Secure Hash Algorithm) engine.

7. The method of claim 1 where the message authentication code is generated using a SHA-1 (Secure Hash Algorithm) engine.

8. The method of claim 1 where the bidirectional communication between the microcontroller and the processor is established through a single wire bus architecture protocol.

9. The method of claim 1 further comprising the steps of:

generating a subsequent message authentication code associated with the identified printer responsive to an error condition generated by the processor; and transmitting the subsequent message authentication code to the processor.

10. A method of communicating a message authentication code for a toner cartridge to a printer having a processor containing a lock-out algorithm, comprising the steps of:

providing a toner cartridge having a microcontroller in bidirectional communication with said processor when the cartridge is installed in the printer;

establishing a look-up table defining a plurality of lapsed-time values associated with a plurality of printer models;

establishing an initial time value responsive to the activation of the microcontroller;

establishing a final time value responsive to a predetermined communication from the processor to the microcontroller;

subtracting the initial time value from the final time value to establish an identification value associated with a printer;

identifying at least one printer by matching the identification value to a lapsed-time value defined on the look-up table;

generating a message authentication code associated with the identified printer; and transmitting the message authentication code to the processor.

11. The method of claim 10 further comprising the step of storing at least one data value associated with a toner cartridge status parameter on the microcontroller.

12. The method of claim 11 where at least one data value stored on the microcontroller is selected from the group consisting of a serial number associated with the microcontroller, a secret code, and a ROM ID.

13. The method of claim 11 where the message authentication code is generated using at least one data value stored on the microcontroller.

14. The method of claim 11 where the message authentication code is generated using at least one data value stored on the microcontroller and a challenge code initiated by the processor.

15. The method of claim 14 where the message authentication code is generated by a SHA-1 (Secure Hash Algorithm) engine.

16. The method of claim 10 where the message authentication code is generated using a SHA-1 (Secure Hash Algorithm) engine.

17. The method of claim 10 where the bidirectional communication between the microcontroller and the processor is established through a single wire bus architecture protocol.

18. The method of claim 10 further comprising the steps of:

generating a subsequent message authentication code associated with the identified printer responsive to an error condition generated by the processor; and transmitting the subsequent message authentication code to the processor.

19. A method of communicating a message authentication code for a toner cartridge to a printer having a processor containing a lock-out algorithm, comprising the steps of:

providing a toner cartridge having a microcontroller in bidirectional communication with said processor when the cartridge is installed in the printer;

establishing a look-up table defining a first voltage value associated with a plurality of printer models;

establishing a second voltage value by measuring the voltage at a point of contact between the microcontroller and the printer;

identifying at least one printer by matching the second voltage value to a first voltage value defined on the look-up table;

generating a message authentication code associated with the identified printer; and transmitting the message authentication code to the processor.

20. The method of claim 19 further comprising the step of storing at least one data value associated with a toner cartridge status parameter on the microcontroller.

21. The method of claim 20 where at least one data value stored on the microcontroller is selected from the group consisting of a serial number associated with the microcontroller, a secret code, and a ROM ID.

22. The method of claim 20 where the message authentication code is generated using at least one data value stored on the microcontroller.

23. The method of claim 20 where the message authentication code is generated using at least one data value stored on the microcontroller and a challenge code initiated by the processor.

24. The method of claim 23 where the message authentication code is generated by a SHA-1 (Secure Hash Algorithm) engine.

25. The method of claim 19 where the message authentication code is generated using a SHA-1 (Secure Hash Algorithm) engine.

26. The method of claim 19 where the bidirectional communication between the microcontroller and the processor is established through a single wire bus architecture protocol.

27. The method of claim 19 further comprising the steps of:

generating a subsequent message authentication code associated with the identified printer responsive to an error condition generated by the processor; and transmitting the subsequent message authentication code to the processor.

* * * * *